United States Patent [19]

Gacki

[11] 4,257,864

[45] Mar. 24, 1981

[54] PORTABLE SILVER RECOVERY UNIT

[76] Inventor: Leonard W. Gacki, 31 Wellington Ter., White Plains, N.Y. 10607

[21] Appl. No.: 62,951

[22] Filed: Aug. 2, 1979

[51] Int. Cl.[3] ..... C25D 17/20; C25C 1/00; F16C 27/00; F16C 17/04

[52] U.S. Cl. ..... 204/213; 204/222; 204/225; 204/271; 204/273; 204/275; 204/285; 204/109; 308/26; 308/36.1; 308/37; 308/72

[58] Field of Search ..... 204/212, 213, 271, 273, 204/275, 109, 285, 222, 225; 308/26, 36.1, 37, 72

[56] References Cited

U.S. PATENT DOCUMENTS

| | | | |
|---|---|---|---|
| 300,950 | 6/1884 | Cassel . | |
| 635,380 | 10/1899 | Goodrich . | |
| 721,402 | 2/1903 | Walters . | |
| 1,251,302 | 12/1917 | Tainton . | |
| 1,954,316 | 4/1934 | Hickman et al. | 204/16 |
| 1,959,531 | 5/1934 | Hickman et al. | 204/5 |
| 2,255,172 | 9/1941 | Johnson | 308/36.1 X |
| 2,255,429 | 9/1941 | Lyons | 204/212 |
| 2,766,201 | 10/1956 | Luther | 204/213 |
| 2,791,555 | 5/1957 | Duisenberg et al. | 204/212 |
| 3,003,942 | 10/1961 | Cedrone | 204/272 |
| 3,342,718 | 9/1967 | Adams | 204/273 |
| 3,458,425 | 7/1969 | Tolle et al. | 204/280 |
| 3,560,366 | 2/1971 | Fisher | 204/212 |
| 3,583,897 | 6/1971 | Fulweiler | 204/212 |
| 3,642,594 | 2/1972 | Crellin | 204/109 X |
| 3,660,265 | 5/1972 | Kangas | 204/213 X |
| 3,666,276 | 5/1972 | Hubler | 308/36.1 X |
| 3,694,341 | 9/1972 | Luck, Jr. | 204/273 |
| 4,054,503 | 10/1977 | Higgins | 204/271 |

OTHER PUBLICATIONS

*Rotex Service Manual,* W. B. Snook Mfg. Co., Inc., (No date).

Schreiber, M., "Present Status of Silver Recovery in Motion Picture Laboratories", (1965), *Jour. Soc. Mot. Pict./TV Engr.*, vol. 74, #6 (Reprint).

Gyori, Robert P. & Scobey, "Some Design Considerations for Electrolytic Silver Recovery from Photographic Fixing Baths", J. Soc. Motion Picture and Television Engineers, Reprint from Aug. 1972, vol. 81, #8.

Duisenberg, Charles E., "A Practical Device for the Recovery of Silver and Prolongation of Life of Fixing Baths", J. Society of Motion Picture and Television Engineers, Aug. 1956, vol. 65, pp. 429–430.

*Primary Examiner*—Howard S. Williams
*Assistant Examiner*—D. R. Valentine
*Attorney, Agent, or Firm*—Burge & Porter Co.

[57] ABSTRACT

A portable unit for recovering metallic silver from photographic processing solutions includes a lightweight, molded tank structure. Spaced, elongate, stationary anodes are disposed within the tank and are positioned parallel to each other. An elongate cathode assembly is supported for rotation in the tank about an axis parallel to the anodes. The cathode assembly includes a specially configured apertured barrel designed to promote efficient contact between photographic solution and the remainder of the cathode components. The barrel is readily removed from the unit and disassembled to permit cathode components to be stripped of plated silver. Alternate cathode constructions are disclosed by which extremely efficient plating and silver recovery may be accomplished. The unit also includes a drive shaft seal assembly for supporting the cathode assembly for rotation. The seal assembly is flexible to permit operation of the device even when misaligned bearing support structures are provided.

38 Claims, 13 Drawing Figures

PORTABLE SILVER RECOVERY UNIT

BACKGROUND OF THE INVENTION

1. Field of the Invention

The invention relates to apparatus for recovering metallic silver from photographic processing solutions containing silver ions and, more particularly, to a compact, portable silver recovery unit having improved characteristics of assembly, plating efficiency, and disassembly.

2. Description of the Prior Art

In the development of x-ray film, movie film, and other types of film, an emulsion previously applied to the surface of the film is contacted by a solution of sodium thiosulfate (hypo). The hypo washes off unhardened silver-containing compound from the surface of the film after development; the silver-containing compound is dissolved and goes into solution. After a period of time, the hypo becomes saturated with silver and no longer is fit for use. Various proposals have been advanced for removing the silver from the hypo to recover the value of the silver and/or rejuvenate the hypo. Three basic methods of silver recovery have been proposed:

A. Metallic replacement. In the metallic replacement technique, silver-saturated hypo is brought into contact with a metal substance such as steel wool, zinc dust, or copper in a form having a large surface area. Silver is attracted out of solution by the metal substance. This is a fairly effective technique for recovering silver with only one basic drawback: The hypo is ruined and must be discarded. In addition to the obvious pollution problems, an entirely new batch of hypo is required and the savings from the efficient silver recovery are mitigated by the need to use more hypo. Moreover, it often is difficult to tell how much silver is in solution and, thus, unsaturated hypo solution may be processed and thrown away needlessly.

B. Chemical precipitation. In the chemical precipitation technique, various chemical compounds are added to silver-saturated hypo to precipitate the silver compound. The chemical precipitation technique suffers from the same drawbacks as does the metallic replacement technique in that the hypo is ruined and must be discarded. The chemical precipitation technique contains additional drawbacks in that the chemicals involved can be difficult to work with, and the efficiency of the process is comparatively low.

C. Electrolytic Precipitation. In the electrolytic technique, two electrodes, a cathode and an anode, are placed in a bath of hypo. Electric current is passed between the electrodes and silver is deposited on the cathode. The chief advantage of the electrolytic technique is that the hypo can be rejuvenated and reused to process additional film. When carried out properly, the efficiency of the electrolytic technique, although lower than the metallic replacement technique, is acceptable. Unfortunately, certain drawbacks of known electrolytic methods and apparatus exist which have made it difficult to employ the electrolytic technique to maximum advantage.

An important problem with the electrolytic technique deals with the cathode surface area presented to the hypo and with the current density required to efficiently remove silver from the hypo. If the current density and/or plating surface area is too low with respect to the amount of silver and other constituents present, the plating efficiency is not high enough and too much time will be required to remove silver from the hypo. On the other hand, if the current density is too high with respect to the amount of silver and other constituents present, silver sulfide will be formed at the cathode and plating of silver will be stopped. Additionally, the hypo will be made unfit for further use. Prior electrolytic methods and apparatus all have attempted to overcome the current density and plating surface area problem, although none has failed to achieve entirely satisfactory results.

In part, this is because it has been difficult, if not impossible, to properly move the hypo past the anodes and the cathodes such that the maximum amount of surface area of the cathodes is presented to the hypo without creating voids or eddy currents. Unless the flow of hypo across the cathode is substantially laminar, the current density applied to the hypo will be variable. In turn, areas of higher current density will initiate the formation of silver sulfide. If continued long enough, the initially formed silver sulfide will spread to other areas of the hypo and the hypo eventually will be ruined. Even if the hypo is not ruined, irregular plating activity can occur and the efficiency of the plating operation decreased.

A basic problem, then, with the electrolytic technique is to effectively bring the hypo into contact with a large cathode surface area so that a large amount of silver can be plated without bringing about the formation of silver sulfide. The problem has been approached fairly well in large installations. In these installations, large, stationary, plate-like anodes and cathodes are spaced a small distance apart and stirrers or paddles are moved slowly between adjacent plates. Installations such as the type described are very large and expensive, and have not been made small enough to be portable. Also, considerable effort is required to remove the cathode plates and strip them of plated silver. Although these large installations are suitable for processing substantial volumes of hypo on a more or less continuous basis, they are unsuited for processing smaller quantities of hypo on a demand basis such as occurs commonly in hospitals, small film processing laboratories, and so forth.

Although portable electrolytic units exist, they all suffer from the drawback of not being able to process the hypo as efficiently as desired. One known unit suspends an elongate cathode assembly vertically in a tank of hypo. The cathode assembly includes a shaft along which a plurality of circular discs are disposed equidistantly. The cathode assembly is rotated in use so that a "shearing" action takes place between the cathode discs and the hypo. Although this device functions well in theory to produce laminar flow across the face of the cathode discs, it does not work as well in practice. In part, this is because silver does not plate evenly onto the surface of the discs and turbulent flow eventually is created after a certain amount of silver has been plated onto the discs. Also, bubbles can be trapped on the underside of the discs and flow irregularities thereby created. Moreover, because the cathode assembly is suspended at only one point, excessive stress is applied to a support bearing and other drive shaft components by which the cathode assembly is suspended.

Other portable devices employ differently configured cathode assemblies, but problems with the cathode assemblies still remain. For example, cylindrical, stationary cathodes have been used in which hypo is moved past the cathode by means of a pump or an impeller. Although a large surface area is presented to the hypo, turbulent flow can result from the technique by which the hypo is pumped and it is difficult to strip plated silver from the cathode without scratching or deforming the cylindrical cathode. In short, all known portable silver recovery devices have had serious problems with respect to (a) properly moving the hypo and the cathode relative to each other for maximum plating efficiency and (b) removing the cathode and stripping plated silver quickly without damaging the cathode components.

SUMMARY OF THE INVENTION

The present invention overcomes the foregoing problems associated with portable silver recovery units and provides a unit having high plating efficiency, but which is easily assembled and disassembled for removal of plated silver. Essentially, the invention includes a tank into which silver-ion-laden film processing solution is directed. A pair of spaced, elongate anodes are disposed within the tank, each anode being maintained stationary with respect to the tank. An elongate cathode assembly is supported for rotation between, and in electrical communication with, a pair of electrodes. An electrical current is passed between the anodes and the cathode assembly so that silver is plated onto the cathode.

A feature of the invention lies in the construction of the cathode assembly. In a preferred embodiment, a porous barrel formed of electrically nonconductive material is provided and cathode components are disposed within the barrel. The barrel is cylindrical and includes removable end caps having apertures which permit fluid to be drawn into the barrel. Large-diameter regions extending axially of the barrel serve as "paddles" to agitate the fluid upon rotation of the barrel. A plurality of circumferentially extending slots formed in the large-diameter regions permit fluid to be discharged from the interior of the barrel. A plurality of thin, disc-like, electrically conductive plates are supported concentrically within the barrel and are spaced equidistantly axially of the barrel. Electrical contacts extend through the end caps to permit electrical current to be conducted to the discs.

A preferred method of disc construction includes molding a disc and a spacer as an integral plastic unit. The unit then is plated with an electrically conductive material by any conventional plastic-plating technique. The discs and spacers include mating notches and tabs which permit a plurality of disc/spacer units to be stacked against each other. The units then can be inserted into the barrel and held in place there by the end caps. Upon disassembly of the barrel, the units can be disassembled and packaged compactly for shipping. Removal of plated silver is made especially easy because the units are intended to be melted. The plastic is melted first and leaves behind essentially pure silver from the electrolytic process.

Other cathode constructions are included as part of the invention, all of which employ a cathode barrel. In one embodiment, an impeller is disposed within the barrel along with a plurality of electrically conductive parts which occupy a portion of the remaining interior space of the barrel. Upon rotation of the barrel, the impeller draws fluid into the barrel through one end cap and discharges fluid through the other end cap and the slots. The parts are tumbled within the barrel in electrical communication with the impeller and each other. Silver is plated onto the parts. As with the discs of the first-mentioned embodiment, the parts can be compactly shipped and melted to displace unwanted plastic interior portions. Yet another embodiment of the cathode employs an elongate rod extending the length of the barrel to which a plurality of paddles are affixed. As in the other embodiments, rotation of the barrel causes fluid to enter the barrel, to flow past the paddles and to flow outwardly of the barrel through the slots.

Another feature of the invention is the drive means by which the barrel is rotated. In a preferred embodiment, the drive means includes a drive shaft disposed within the tank and against which a portion of the barrel comes into contact. In order to rotate the barrel, the drive shaft is rotated and, due to frictional contact between the drive shaft and the barrel, the barrel is rotated.

In order to seal the drive shaft against leakage at the interface between the drive shaft and the tank, a shaft seal is provided. The shaft seal also is a feature of the invention. The seal includes a flexible, fluid-tight web extending completely across an opening in the tank sidewall. The web includes an opening within which a bearing is secured. Preferably, the bearing is a relatively friction-free material such as nylon which can be bonded to the web in fluid-tight relationship. The shaft is tightly fitted within an opening extending through the bearing. Flexible seals are pressed against the bearing and are tightly fitted about the shaft at that point where the shaft extends through the end faces of the bearing. The seals are held in place either by bushings or by a drive gear. Due to the flexible nature of the web, the bearing and the shaft can be moved with respect to the sidewall to which the web is attached. This construction permits the tank to be manufctured from inexpensive materials not requiring tightly controlled tolerances. The unit can be assembled rapidly without concern for careful alignment of the sidewalls, the bearing, and the drive shaft. These and other features and advantages, and a fuller understanding of the invention may be had by referring to the following description and claims, taken in conjunction with the accompanying drawings.

DESCRIPTION OF THE PREFERRED EMBODIMENT

Figure 1:
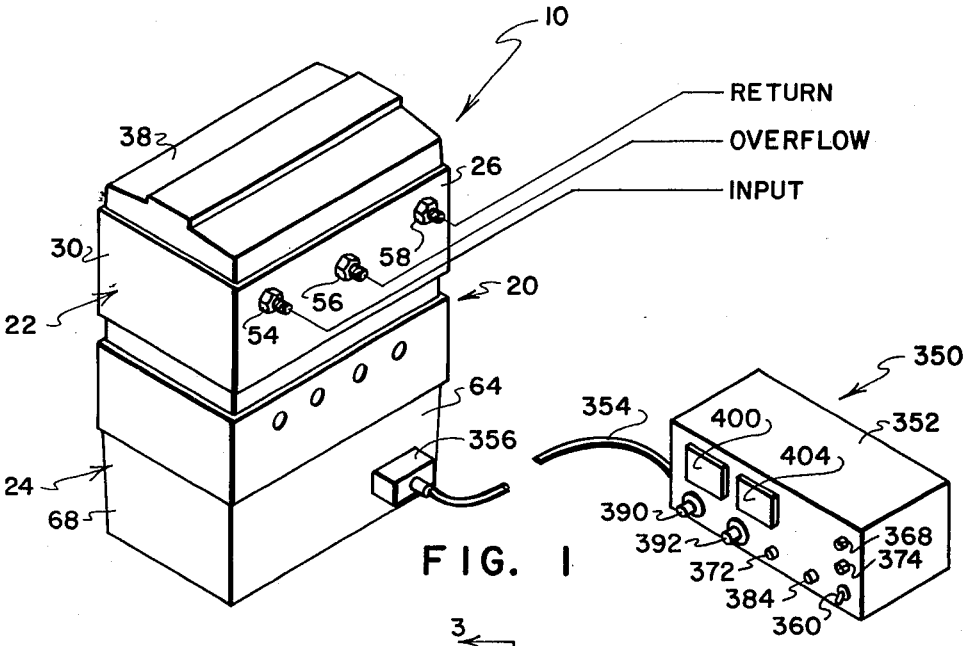
FIG. 1 is a perspective view of a silver recovery unit according to the invention to which a control assembly is connected.

Referring to FIG. 1, a portable silver recovery unit is indicated generally by the numeral 10. The unit 10 is of a type intended for use in hospitals, film processing laboratories, and so forth to remove silver from photograhic processing solutions. A typical film processing solution includes sodium thiosulfate, or sodium hyposulfite, referred to generally as "hypo."

The unit 10 includes a housing assembly 20 within which various components of the unit 10 are disposed, as well as a control assembly 350 which controls operation of the components disposed within the housing assembly 20. The housing assembly 20 includes a tank-defining section 22 and a support section 24. A pair of anodes 80 are disposed within the tank 22 and are connected to a source of electrical current as will be described. A cathode assembly 100 also is disposed within the tank 22, as well as portions of a cathode assembly drive 200. Other portions of the cathode assembly drive 200 are disposed within the support section 24. The unit 10 also includes a pump assembly 300 having various conduits, fittings, and so forth. Operation of the cathode assembly drive 200, the pump assembly 300 and the control of electrical current supplied to the anodes 80 and the cathode assembly 100 is controlled by the control assembly 350.

I. The Housing Assembly 20

Figure 2:
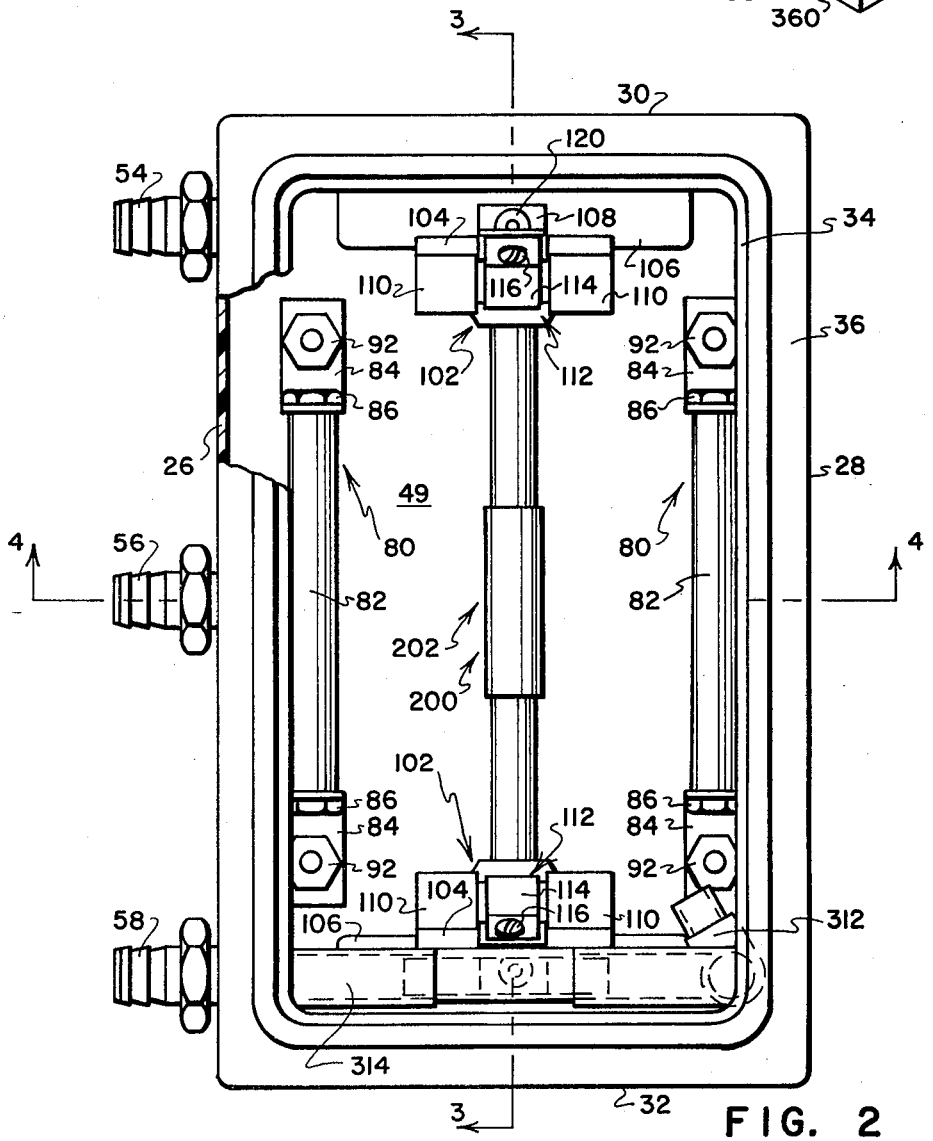
FIG. 2 is a plan view of the unit of FIG. 1 with a cover removed and a portion of a sidewall broken away.
Figure 3:
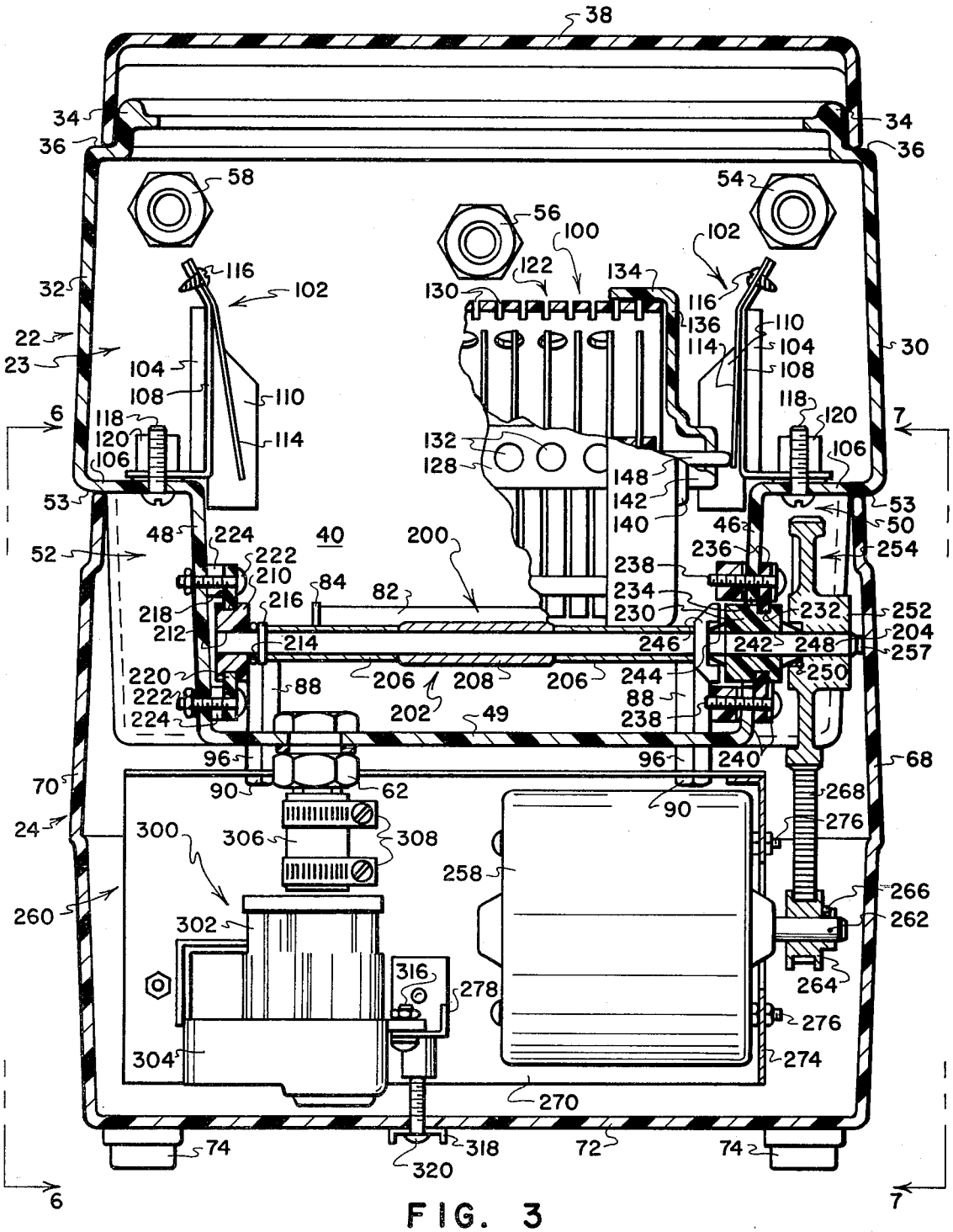
FIG. 3 is a sectional view as seen from a plane indicated by line 3—3 in FIG. 2 with portions of a cathode assembly broken away and removed for clarity.
Figure 4:
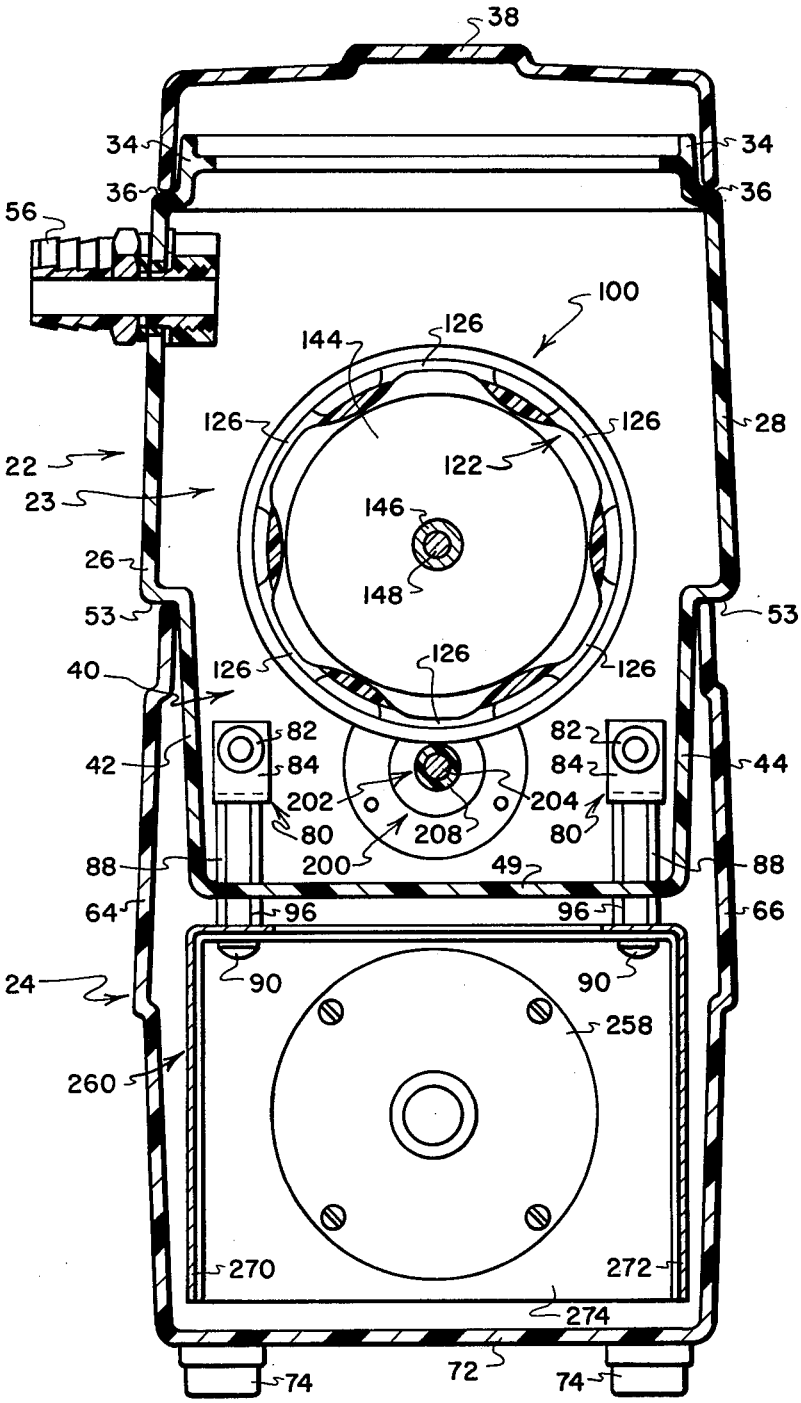
FIG. 4 is a sectional view as seen from a plane indicated by line 4—4 in FIG. 2.

The housing assembly 20 is formed entirely of inexpensive, durable plastic materials. This construction is lightweight, yet strong, and the housing assembly 20 is exceedingly long-lived because it is not subject to attack by chemicals being processed. Referring to FIGS. 2–4, the tank 22 includes an upper portion 23 having a front wall 26, a rear wall 28 and end walls 30, 32. An upwardly extending rim 34 extends about the periphery of the walls 26, 28, 30, 32 at their upper ends. The rim 34 defines a ledge 36 against which the lower portion of a rectangular cover 38 is fitted. Like the other components of the housing assembly 20, the cover 38 is molded from a plastic material.

The tank 22 also includes a lower portion 40 having a front wall 42, a rear wall 44, end walls 46, 48 and a bottom wall 49. The end walls 46, 48 and spaced inwardly from the lateral extent of the walls 42, 44, so that recessed portions 50, 52 are defined at either side of the lower portion 40. The walls 42, 44 are spaced inwardly from the lowermost portion of the walls 26, 28. This construction defines a ledge 53 extending about the periphery of the tank 22 at the interface between the upper portion 23 and the lower portion 40. The tank 22 also includes openings into which a plurality of fittings 54, 56, 58, 60 and 62 are secured. The fittings 54–62 conduct fluid into and out of the tank 22 in a manner as will be described.

The lower housing section 24 is an open-ended box-like structure having a front wall 64, a rear wall 66, end walls 68, 70, and a bottom wall 72. Rubber feet 74 are secured to the underside of the bottom wall 72 near the corners to provide a non-slip support for the unit 10. The dimensions of the lower section are selected such that the lower portion 40 nests within the lower section 24. The upper peripheral edge of the lower section 24 engages the ledge 53.

II. The Anodes 80

The anodes 80 are disposed within the tank 22 and are positioned toward the lowermost part of the lower portion 40. The anodes 80 are elongate structures rigidly secured within the tank 22 and are positioned parallel and adjacent to the front wall 42 and the rear wall 44. Each anode 80 is substantially identical and includes a cylindrical carbon rod 82 to which an L-shaped support bracket 84 is secured at either end by means of fasteners 86. The brackets 84 and the fasteners 86 are electrically conductive. The brackets 84 are spaced a small distance above the bottom wall 49 by means of electrically non-conductive spacers 88. A bolt 90 extends through each spacer 88 and is secured at one end to the bracket 84 by means of a nut 92. The bolt passes through openings in the bottom wall 49. The bolts also pass through openings in a mounting bracket 260. The bracket 260 is spaced from the underside of the bottom wall 49 by means of spacers 96 through which the bolts 90 extend. The mounting bracket 260 is a channel-like structure made of stainless steel capable of conducting electricity and also capable of supporting various components of the unit 10. When the electrical current is conducted to the mounting bracket 260, the current can flow to the anodes 80 by way of the bolts 90, the brackets 84, and the fasteners 86.

III. The Cathode Assembly 100

The cathode assembly 100 is disposed within the tank 22 and portions of the cathode assembly 100 are supported for rotation about a horizontal axis. The cathode assembly 100 includes a pair of electrodes 102 disposed at opposite ends of the tank 22 toward the end walls 30, 32. Each electrode 102 includes a vertically extending, electrical non-conductive, rectangular plate 104 secured to a horizontally extending portion 106 of the tank 22 by means of an L-shaped bracket 108. A pair of vertically extending, electrically non-conductive guides 110 are secured to the plate 104 at opposite sides of the plate 104 to define a vertically extending channel 112. A flexible, elongate, vertically extending tab 114 is secured to the upper end of the bracket 108 by means of a fastener 116. The other end of the bracket 108 is secured to the ledge 106 by means of a bolt 118 extending through an opening in the ledge 106, the bolt 118 receiving a nut 120. The electrodes 102 thus are rigidly secured within the tank 22 and the tabs 114 are made electrically conductive with exterior portions of the tank 22 by means of the connection with the brackets 108 and the bolts 118.

Figure 8:
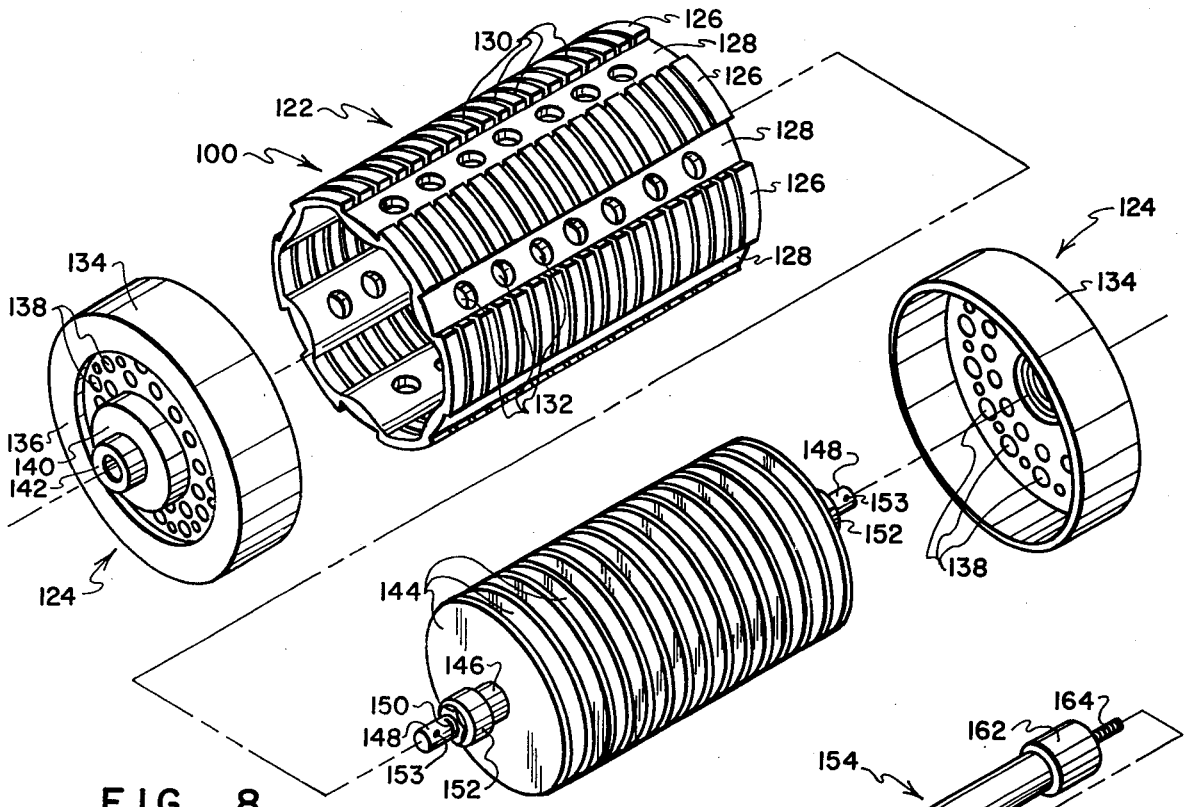
FIG. 8 is an exploded, perspective view showing components of a preferred cathode assembly.

The rotatable portion of the cathode assembly 100 is adapted to extend between the spaced electrodes 102 and to be supported for rotation there. The rotatable portion of the cathode assembly 100 includes a generally cylindrical barrel 122 having apertured end caps 124. The barrel 122 and the end caps 124 are formed from an inexpensive, easily moldable electrically non-conductive plastic substance. Referring particularly to FIGS. 3, 4, and 8, the barrel 122 includes alternating axially extending, larger-diameter portions 126 and smaller diameter portions 128. The larger-diameter portions 126 include a plurality of equidistantly spaced, circumferentially extending slots 130. The smaller-diameter portions 128 include a plurality of equidistantly spaced apertures 132. The end caps 124 include a circumferential skirt 134 having an inner diameter equal or slightly larger than the outer diameter of the larger diameter portions 126. The end caps 124 each include an end surface 136 having a plurality of apertures 138. An annular formation 140 extends outwardly from the central portion of the end surface 136 and carries a concentric projecting hub 142.

In a preferred embodiment of the cathode assembly 100, a plurality of circular, plate-like thin discs 144 separated by spacers 146 are disposed concentrically within the barrel 122. The discs 144 define cathode elements on which silver is plated; the cathode elements must be electrically conductive and should have a smooth surface to assist in plating a uniformly thick layer of silver. In one form, the discs 144 are made of stainless steel and the spacers 146 are made of an electrically conductive material. In another, and preferred, form, each disc 144 and its adjacent spacer 146 is molded from an inexpensive plastic material in a unitary assembly and thereafter coated with a thin layer of electrically conductive material. The plating of the plastic disc/spacer combination can be accomplished by any conventionally known technique. In the preferred form, each disc 144 and spacer 146 includes a notch and tab (not shown) in order to permit a number a disc/-spacer units to be secured to each other in a manner like that shown in FIG. 8 so that relative movement between adjacent disc/spacer units is not possible.

In order to mount the cathode elements within the barrell 122, a shaft 148 can be passed through the center of the assembled discs and spacers. Nuts 150 can be threaded onto the ends of the shaft 148 to clamp the disc/spacer assemblies securely in place on the shaft 148. The length of the shaft 148 is selected such that it extends through openings in the hubs 142. Rubber bushings 152 are fitted over the nuts 150 to provide a resilient interface between the nuts 150 and the inner surface of the end caps 124. Each end of the shaft 148 includes a laterally extending opening 153 into which a cotter pin or fastener can be inserted. By this technique, upon forcing the end caps 124 toward each other in place about the barrel 122, the bushings 152 will be compressed. In turn, the cathode elements will be tightly retained within the barrel 122.

After the cathode assembly 100 has been assembled, it can be easily inserted into, and removed from, the tank 22. When the cathode assembly 100 has been inserted properly into the tank 22, the hubs 142 fit within the channels 112 and the ends of the shaft 148 engage the tabs 114. Accordingly, the cathode assembly 100 is placed in electrical communication with the electrodes 102 and adequate rotational support for the cathode assembly 100 is provided. The hubs 142 insure that the cathode assembly 100 always is oriented parallel to the longitudinal axis of the anodes 80.

Figure 9:
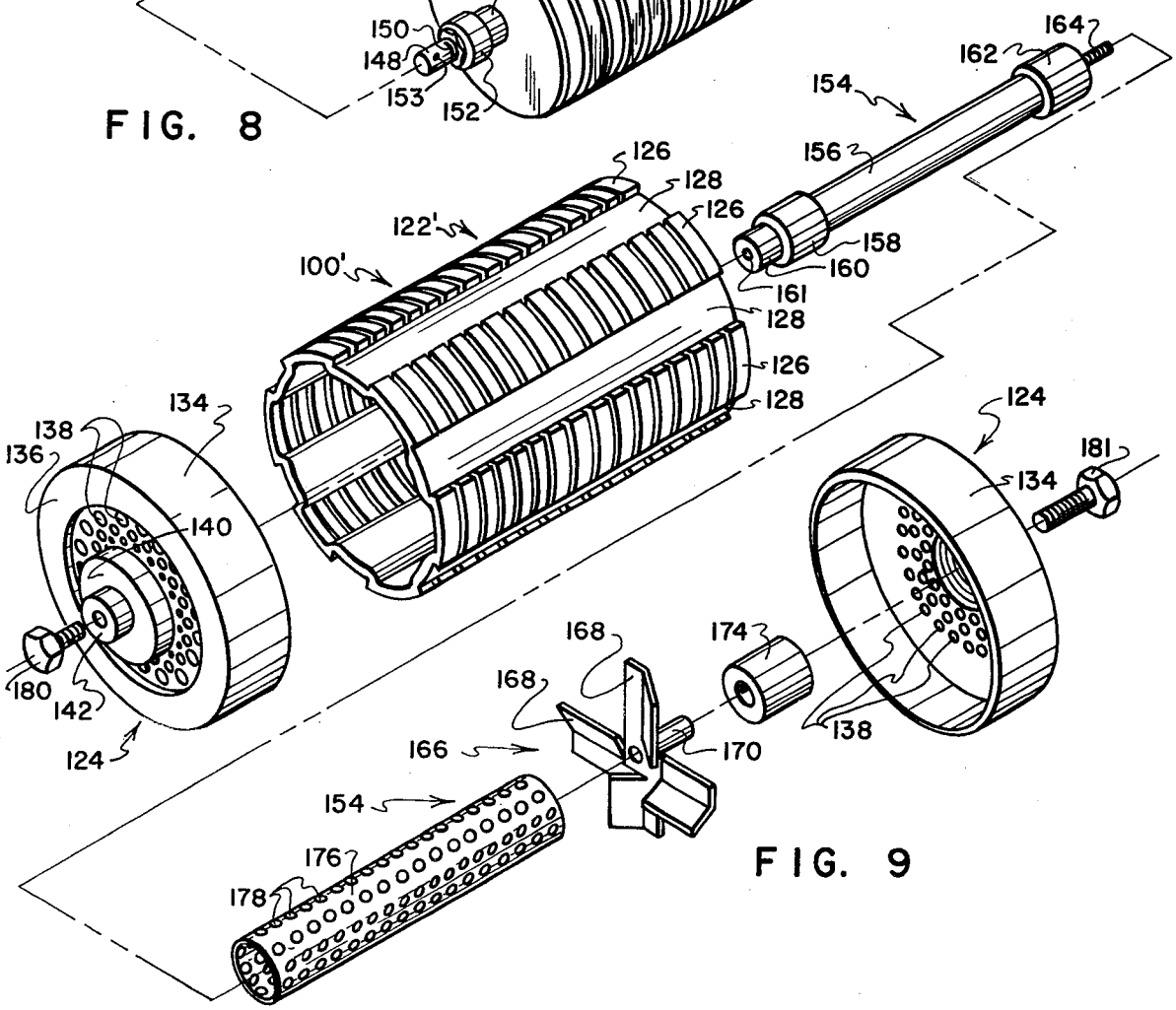
FIG. 9 is an exploded perspective view of an alternate embodiment of a cathode assembly.
Figure 10:
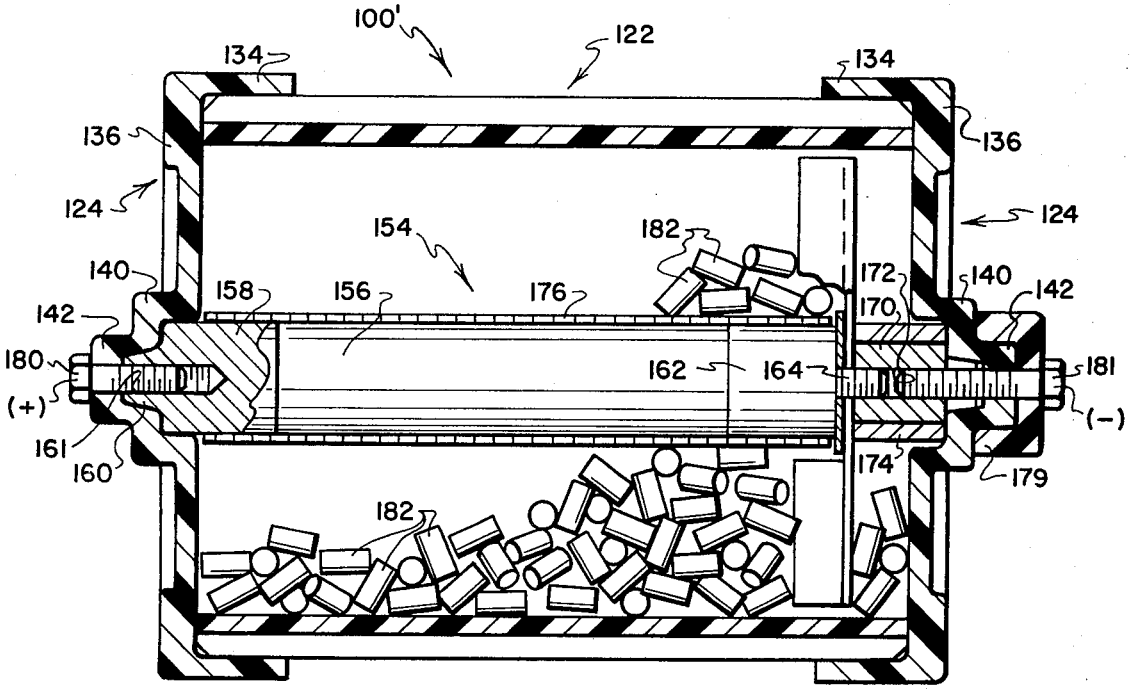
FIG. 10 is a sectional view of the cathode assembly of FIG. 9 showing a plurality of metallic cathode elements.

An alternate embodiment of the cathode assembly 100 is shown in FIGS. 9 and 10. Many of the components of this embodiment are the same or similar to those used in the earlier-described embodiment. Where components of exactly identical configuration are employed, the same reference numerals will be used. Where components of similar construction are employed, reference numerals bearing a "prime" mark will be used. Where entirely new components are employed, entirely new reference numerals will be used.

The embodiment of FIGS. 9 and 10 employs an anode/cathode assembly 100' having a modified barrel 122'. The only difference between the barrel 122 and the barrel 122' is that the barrel 122' lacks the apertures 132 formed in the smaller-diameter portion 128. The end caps 124 remain unchanged. A different anode element 154 is employed. The anode element 154 includes an elongate carbon rod 156 having an insulator 158 attached to one end. The insulator 158 includes a reduced diameter neck 160 engageable with the inner surface of the hub 142. A threaded, longitudinally extending opening 161 is formed in the end of the rod 156. An insulator 162 is secured to the other end of the rod 156. A threaded rod 164 extends concentrically from the end surface of the insulator 162.

An impeller 166 having a plurality of vanes 168 includes a hub 170 having a threaded, longitudinally extending opening 172. The rod 164 is threaded into one end of the opening 172. A rubber insulator in the form of a bushing 174 fits snugly about the hub 170. An elongate, plastic sheath 176 having a plurality of apertures 178 is disposed about the rod 156 and tightly engages the insulators 158, 162. The sheath 176 is spaced from the rod 156. A spacer 179 is fitted about the hub 142 of the end cap 124 located closest to the impeller 166. The difference in diameter between the hub 142 and the spacer 179 can be used to orient the anode/cathode assembly 100' properly within the tank 22 as will be described. A pair of bolts 180, 181 extend through the hubs 142 and the spacer 179 and are secured within the threaded openings 161, 172 included as part of the rod 156 and the hub 170. Upon tightening the bolts 180, 181, the anode/cathode assembly 100' is secured together in a rigid assembly. The bolts 180, 181 serve as electrodes of opposite polarity.

In order to increase the plating capacity of the anode/cathode assembly 100' a plurality of electrically conductive parts 182 are disposed within the barrel 122'. The parts 182 may take the form of small stainless steel tubes. Many other configurations of the parts 182 are possible, provided the parts are electrically conductive and are configured such that a large surface area is presented. Preferably, the parts 182 are molded from a plastic material and precoated with an electrically conductive material in a manner similar to the preferred form of the discs 144 and the spacers 146.

Figure 11:
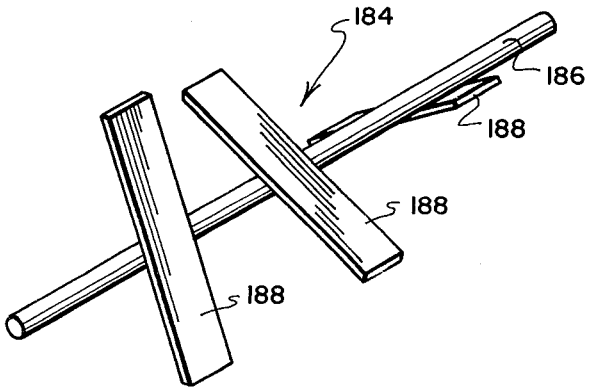
FIG. 11 is a perspective view of an alternate embodiment of a cathode for use in the cathode assembly.

An alternate, less preferred embodiment of a cathode element 184 is shown in FIG. 11. The cathode element 184 includes an elongate rod 186 the same size and shape as the rod 148. A plurality of rectangular paddles 188 are secured to the outer surface of the rod 186 at different angular orientations and at different axial spacings along the length of the rod 186. The entire cathode element 184 is made of an electrically conductive material so that silver will be plated on all exposed portions of the cathode element 184, and also onto parts 182 which are used in conjunction with the cathode element 184.

IV. The Cathode Assembly Drive 200

The cathode assembly drive 200 includes a drive shaft 202 which (a) determines the vertical position of the cathode assembly 100 in the tank 22 and (b) rotates the cathode assembly 100. The drive shaft 202 includes an elongate, stainless steel rod 204. Spaced rubber drive sleeves 206 are molded or fitted onto the outer surface of the rod 204 at axial locations which will engage the skirt 134 of the end caps 124 when the cathode assembly 100 is inserted into the tank 22. A loosely fitting cylindrical spacer 208 is positioned on the rod 204 intermediate the spaced drive sleeves 206.

One end of the drive shaft 202 is supported for rotation by a bearing 210. The bearing 210 is positioned entirely within the tank 22 and includes a central opening 212 within which the rod 204 fits snugly. The bearing 210 is formed of a relatively friction-free material such as NYLON or TEFLON. An O-ring 214 and a washer 216 are fitted about the end of the rod 204 and bear against the bearing 210 at one end of one of the drive sleeves 206. A circumferential groove 218 is formed in the outer surface of the bearing 210. A flexible, disc-like web 220 is fitted into the groove 218. The web 220 is secured to the inner surface of the wall 48 by means of bolted fasteners 222 extending through the wall 48. Spacers 224 provide a fluid-tight seal and space the bearing 210 a small distance from the inner surface of the wall 48.

A bearing 230 supports the other end of the drive shaft 202. The bearing 230 is formed of a relatively friction-free material such as NYLON or TEFLON and includes a circumferential groove 232 formed in its outer surface. The wall 46 includes an opening 234 having a diameter greater than the outer diameter of the bearing 230. A flexible, fluid-tight web 236 is disposed in the circumferential groove 232 and is secured to the outer surface of the wall 46 completely about the periphery of the opening 234. The attachment between the web 236 and the wall 46 is made fluid-tight by bolted fasteners 238 which extend through openings in the web 236 and the wall 46. The fasteners 238 also compress a pair of washers 240 against the outer surface of the web 236 and the inner surface of the wall 46. The washers 240 help to distribute the compressive force applied by the fasteners 238.

The rod 204 fits snugly within an opening 242 formed in the bearing 230. In order to insure that a leak does not occur at this interface, a flexible, conical seal 244 is compressed against the inner end surface of the bearing 230 by means of a bushing 246 secured to the rod 204. A flexible, conical seal 248 is fitted over the end of the rod 204 and bears against the outer end surface of the bearing 230. The seal 248 is compressed in place against the bearing 230 by a recessed portion 250 of a hub 252 included as part of a sprocket 254. The sprocket 254 is keyed to the rod 204 by a set screw (not shown) to provide a driving relationship between the sprocket 254 and the rod 204. By moving the bushing 246 (which is rigidly mounted to the rod 204) and the sprocket 254 toward each other, the seals 244, 248 will be compressed tightly against the end surfaces of the bearing 230. A fluid-tight seal thus will be effected. In order to lubricate the rod 204 to permit it to turn more freely within the bearing 230, an axially extending openings 256 is formed in the end of the rod 204. The opening 256 opens through a surface of the rod 204 at an axial location within the bearing 230. Lubricant can be injected periodically into the opening 256 to lubricate the drive shaft when needed. The opening 256 is closed by a suitable seal such as a screw 257 in order to prevent the loss of lubricant.

Bearings 210, 230 represent an important feature of the invention. It is expected that the housing assembly 20 will be manufactured from inexpensive, moldable plastic components. Due to the flexible nature of the webs 220, 236, the bearings 210, 230 can be moved into alignment with each other to permit the drive shaft 202 to turn freely. If the bearings 210, 230 were secured rigidly to the walls 46, 48, this result would not be possible. Accordingly, the bearing construction included as part of the invention permits the unit 10 to be assembled and operated without particular concern that the walls of the housing are parallel to each other. It has been found that a misalignment of up to 10 degrees can be tolerated without impairing the performance of the bearings 210, 230. This is an important advantage which permits the units 10 to be manufactured inexpensively and assembled rapidly.

An electric motor 258 is mounted to the bracket 260. The motor 258 drives the sprocket 254 by way of a drive shaft 262, a drive sprocket 264 keyed to the drive shaft 262 by a set screw 266, and a toothed drive belt 268. The drive belt 268 is sufficiently flexible that a slight misalignment between the sprocket 254 and the sprocket 264 is accomodated.

The mounting bracket 260 includes a pair of L-shaped plates 270, 272 occupying a major portion of the lower housing portion 24. The plates 270, 272 are connected at one end by an end plate 274. The motor 258 is secured to the end plate 274 by fasteners 276. Additional support for the mounting bracket 260 is provided by a brace 278. The brace 278 connects the plates 270, 272 at a point near the middle of the plates 270, 272. All of the components of the mounting bracket 260 are formed of electrically conductive materials such as stainless steel. Accordingly, they not only can conduct electricity, but they also are quite strong and are not susceptible to corrosion.

V. The Pump Assembly 300

The pump assembly 300 includes an impeller 302 and a motor 304. A magnetic connection (not shown) connects the motor 304 to the impeller 302 so that the motor 304 will have no contact with fluid being processed. An inlet line 306 conveys fluid from the bottom of the tank 22 to the impeller 302. The inlet line 306 is secured to the fitting 62 and the impeller 302 by means of clamps 308. An outlet line 310 conveys fluid under pressure from the impeller 302 to the fitting 60. Referring particularly to FIG. 2, on the inside of the tank 22, a downwardly extending conduit 312 (only the bottom of which is shown), discharges pumped fluid from the outlet line 310 back into the tank 22. A horizontally extending conduit 314 connects the portion of the fitting 60 extending inside the tank 22 with the portion of the fitting 58 extending inside the tank 22. An optional valve 315 (shown schematically in FIG. 12) can be secured to the side of the fitting 58 outside the tank 22. With the valve 315 closed, pumped fluid will be recirculated entirely from the inlet line 306 through the outlet line 310 back into the tank 22. If the valve 315 is open, a portion of the recirculated fluid will be directed through the conduit 314 and out of the tank 22 through the fitting 58. The conduit 312 can be capped, in which case all recirculated fluid will be sent back to the film processor. This so-called external recirculation is done when it is desired to extend the useful life of the film processing solution.

The pump assembly 300 is attached to the brace 278 by fasteners 316. This attachment, in addition to the attachment provided by the inlet line 306 and the outlet line 310, securely mounts the pump assembly 300 within the lower housing portion 24.

In order to connect all of the components into a rigid assembly, a channel-shaped brace 318 is positioned against the underside of the bottom wall 72. A pair of spaced fasteners 320 extend through openings in the bottom wall 72 and engage threaded openings in the brace 278. Upon tightening the fasteners 320, the components will be locked together, except for the cover 38 which still can be removed.

VI. The Control Assembly 350

Figure 5:
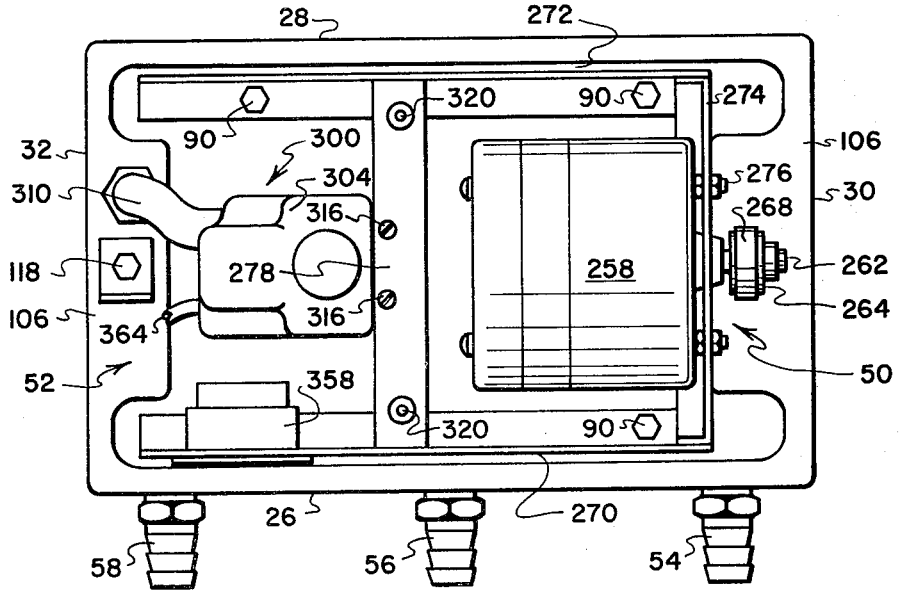
FIG. 5 is a bottom view of the unit of FIG. 1 with a housing support section removed.
Figure 6:
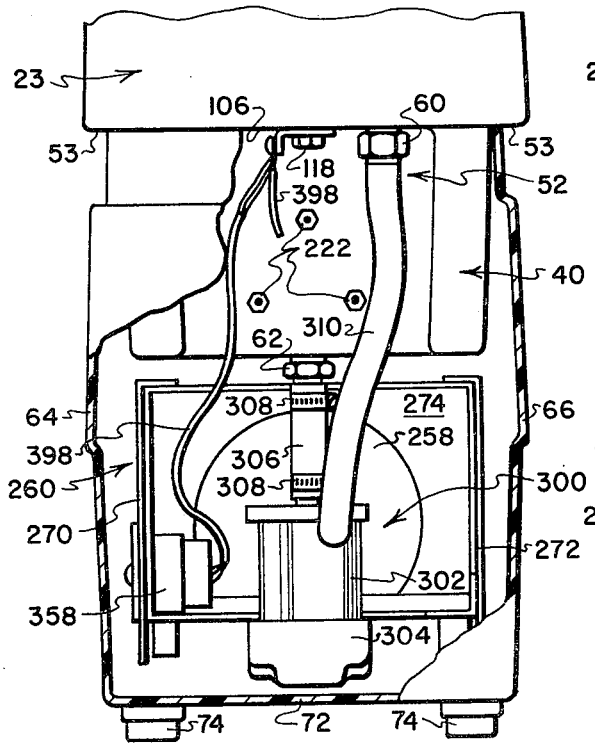
FIGS. 6 and 7 are views seen along planes indicated by lines 6—6 and 7—7, respectively, in FIG. 3 with portions of tank end walls broken away and removed for clarity.
Figure 7:
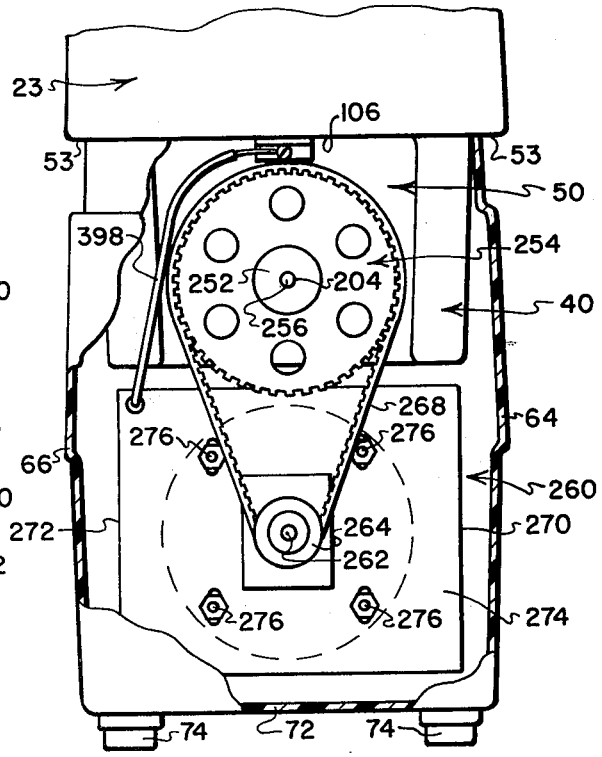

The control assembly 350 includes a control box 352 within which many of the components of the control assembly 350 are located. The control box 352 is connected to the housing assembly 20 by a multi-strand cable 354 having a plug-in connector 356 at one end. A receptacle 358 (FIGS. 5 and 6) receives the connector 356 and provides an attachment point for various electrical leads.

Certain of the electrical leads and other components of the control assembly 350 have been omitted from FIGS. 1–12. FIG. 13 is a schematic diagram of the circuitry employed as part of the invention and all of the components of the control assembly 350 are illustrated in FIG. 13.

The basic function of the control assembly 350 is to power the motor 258 so that the cathode assembly drive 200 is activated, and, hence, the cathode assembly 100 is rotated. The control assembly 350 also powers the pump assembly 300 so that fluid is circulated as desired within and from the tank 22. The control assembly 350 additionally applies a direct current voltage across the anodes 80 and the cathode assembly 100 so that electrical current flows through fluid in the tank 22, the magnitude of the current flow being controlled as a function of the efficiency of the plating operation being conducted.

Referring particularly to FIG. 13, electrical current is supplied to the control box 352 by way of lines L1 and L2. A single throw, double pole switch 360 controls the flow of electrical current through the control box 352. Electrical current is conducted via the lead lines L1 and L2 to a step down transformer 362. Line L1 is connected to a lead line 363 which in turn is connected to a contact 365 included as part of an external plug 366. Line L2 is connected to a lead line 364 which connects the motor 258 and the motor 304 with each other. A pilot light 368 is connected across the lines 363, 364 and, hence, the poles of the switch 360 so that, upon closing the switch 360, the pilot light 368 will be lighted to indicate a closed-switch position. In order to complete a circuit with the motors 258, 304, a lead line 370 is connected to the motors and to another contact 371 in the plug 366. The motors 258, 304 are connected in parallel. A fuse 372 is included in the line 370. A pilot light 374 is connected across the leads 364, 370 to indicate when current is flowing to the motors 258, 304. One end of the primary coil of the transformer 362 is connected to the line 364, while the other end of the primary coil is connected to the line 370. If the connector 366 bridges the gap between the lead lines 363, 370, and the switch 360 is closed, the lights 368, 374 will be lighted and the motors 258, 304 will be energized. The transformer 362 also will be energized. The motors 258, 304 will be operated at a constant speed.

The output of the transformer 362 is used to energize the anodes 80 and the cathode assembly 100. One end of the secondary coil of the transformer 362 is connected to a rectifier 376 by means of a lead wire 378. The other end of the secondary coil is connected to the rectifier 376 by means of a lead wire 380. The transformer 362 reduces the line voltage to approximately six volts which is applied across the rectifier 376. The rectifier 376 converts the stepped-down alternating current voltage to direct current voltage.

A lead line 382 is connected to the negative side of the rectifier 376. A fuse 384 is placed in the line 382. The line 382 is connected to a line 386. A capacitor 388 is connected in the line 386, along with a "low level" rheostat 390 and a "high level" rheostat 392.

A line 394 is connected to the positive side of the rectifier 376 and also is connected to the line 386 on the positive side of the capacitor 388. A line 396 is connected to the line 386 at a point intermediate the rheostats 390, 392 and is connected at the other end to a contact 397 in the plug 366. A line 398 is connected to another contact 399 in the connector 366 and is connected at its other end to the cathode assembly 100. An ammeter 400 is placed in the lead line 398. A line 402 is connected at one end to the lead line 398 and at the other end to the line 386 on the positive side of the capacitor 388. A voltmeter 404 is placed in the line 402. A line 406 extends from the junction of the lines 386, 394, 402 and is connected to the anodes 80.

When the plug 366 is in place, the contacts 365, 371 and 397, 399 are bridged, and the lines 363, 370 and 396, 398 are connected. Upon closure of the switch 360, the control assembly 350 thus is energized. Operation of the motors 258, 304 has been described already. Upon energization of the rectifier 376, a potential difference is established between the anodes 80 and the cathode assembly 100, with the anodes 80 being at a positive potential with respect to the cathode assembly 100. Because the anodes 80 and the cathode assembly 100 are immersed in a solution containing silver ions, the potential difference between the anodes 80 and the cathode assembly 100 will cause silver to be plated onto the cathode assembly 100, all as is well known in the art. The degree of plating activity depends, in part, upon the concentration of silver ions and upon the current density supplied to the anodes 80 and the cathode assembly 100.

If desired, the plug 366 can be replaced by an optional external control (not shown). Such an external control might monitor the activity of a film processor and activate the rheostat 392 when a high level of film processing activity is occurring. If little or no film processing activity is occurring, the rheostat 390 is activated to keep a small flow of current (on the order of 100 milliamps or less) flowing between the anodes 80 and the cathode assembly 100. If the plug 366 is employed, the leads 363, 370 and the leads 396, 398 essentially are shorted and control of the current density is left to the operator through appropriate adjustments of the rheostat 390. The ammeter 400 and the voltmeter 404 permit current density and voltage to be monitored.

VII. Operation of the Unit 10

Figure 12:
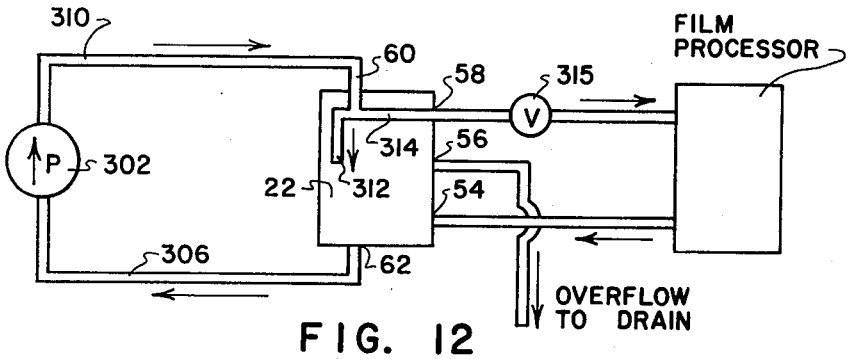
FIG. 12 is a schematic diagram of fluid flow to and through the unit of FIG. 1.
Figure 13:
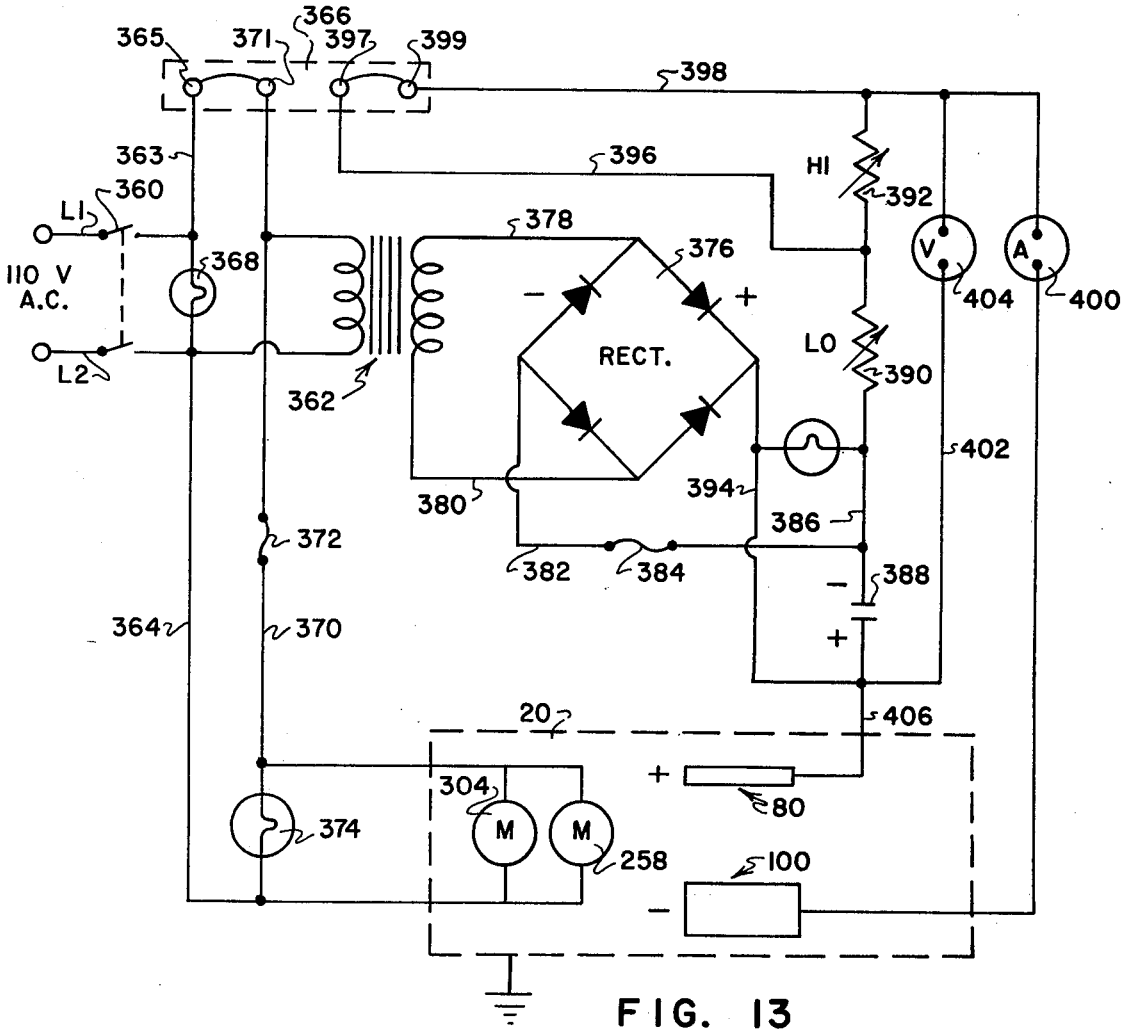
FIG. 13 is a schematic diagram of electrical circuitry employed with the invention.

Referring particularly to FIGS. 1, 12 and 13, when it is desired to operate the unit 10, fluid is pumped to the unit 10 from a film processor through an input connected to the fitting 54. After enough fluid has entered the tank 22 so that the anodes 80 and the cathode assembly 100 are submerged, the control unit 350 is activated by closing the switch 360. The motors 258, 304 are activated, the cathode assembly 100 is rotated, and the impeller 302 circulates fluid from the inlet line 302 back into the tank 22 by way of the outlet line 310. If the valve 315 has been opened, recirculated fluid will be directed back into the film processor. A portion of the fluid will be directed into the tank 22. If the valve 315 has been closed, all of the recirculated fluid will be directed back into the tank 22. Eventually, if sufficient fluid has been added to the tank from the film processor, excess fluid in the tank 22 will be discharged through the fitting 56 and exhausted to a drain. The fitting 56 is located vertically in the wall 26 at a level above the uppermost portion of the cathode assembly 100, but below the level of the fittings 54, 58. The fitting 56 thus acts as an overflow to control the level of fluid in the tank 22.

The cathode assembly 100 represents an important feature of the invention. After the various components have been placed inside the barrel 122 and the end caps 124 have been secured to the barrel 122, it is easy to insert the cathode assembly 100 into the tank 22. Misalignment between the barrel 122 and the electrodes 114 for all practical purposes is impossible because of the interaction between the hubs 142 and the channels 112. Because the skirts 134 ride upon the drive shaft 202, the weight of the cathode assembly 100 is supported by the drive shaft 102, and not by the electrodes 114. Because the cathode elements rotate about a horizontal axis, it is impossible for air to be trapped on the underside of the discs 144. Rotation of the barrel 122 causes the larger-diameter portions 126 to act as paddles which provide the proper amount of agitation to the fluid within which the barrel rotates. The rotation of the barrel 122 creates a low pressure region between the plates 144 such that fluid is drawn into the barrel 122 through the end caps 124 and is discharged from the barrel through the slots 130 and the apertures 132. This type of fluid flow has been found to be extremely effective in plating silver onto the discs 144.

In the cathode assembly 100', the impeller 166 draws fluid into the barrel 122' through one of the end caps 124. When the anode/cathode assembly 100' is used, the channel 112 closest to the conduit 312 is made wider than the other channel 112 in order to accommodate the spacer 179. In this mode, the line 398 is connected to the electrode 102 closest to the conduit 312 and the line 406 is connected to the other electrode 102. Accordingly, the rod 156 is charged positively and the impeller 166 and the parts 182 are charged negatively; improper electrical connection is not possible because the barrel 122' cannot be inserted improperly. Because the apertures 132 have been omitted from the barrel 122', the parts 182 are contained within the barrel 122'. The tumbling action of the parts 182 not only insures good electrical conductivity among the parts, but also avoids the entrapment of air bubbles. Regardless of which embodiment of the cathode assembly is used, the cathode elements are contained within the barrel 122, 122' such that they cannot be damaged regardless of how carelessly the cathode assembly 100, or the anode/cathode assembly 100' is inserted into, or removed from, the unit 10.

By appropriate adjustment of the rheostats 390, 392, the current density applied to the anodes 80, the rod 156, and the cathode assembly 100 can be controlled. In turn, the degree of plating activity at the cathode assembly 100 can be controlled.

Various approaches to the problem of control of current density versus plating activity have been devised. The control assembly 350 is versatile enough to operate according to these various approaches. For example, if plating activity is desired to be stopped, the connection across lines 363, 370 can be opened. Typically, this would be done where no more hypo is being circulated through the unit 10. Generally, when hypo is being circulated through the unit 10, it will be desirable to apply some current, however small, across the anodes 80 and the cathode assembly 100. The connection across the lines 396, 398 can be opened or closed as required by an external control circuit monitoring the entering hypo solution. In this circumstance, the rheostats 390, 392 can be preset to constant desired levels. When hypo from a film processor is directed into the tank 22, the "high" level can be selected so that maximum current density is applied either for a fixed period of time or until the level of silver ions in the solution has decreased sufficiently. For example, if the unit 10 must run for five minutes to remove silver ions for every minute of film processor operation, then an external timer can control operation of the unit 10 at the "high" setting for five times as long as the time the processor runs.

After enough silver has been removed, continued high current will cause the formation of sodium sulfide and eventually will ruin the hypo. Accordingly, after the passage of a certain amount of time or after the level of silver ions in the solution has decreased to a certain level, the "low" setting can be selected to apply a continuous low level of current. This can be controlled externally by monitoring the amount of siler remaining in the solution being processed.

The silver recovery unit according to the invention is a compact, portable unit having great versatility. The operating components are reliable in operation, and significant portions of the unit coming into contact with various chemical solutions can be moled from inexpensive, long-lived plastic materials. The cathode assembly according to the invention permits even unskilled or untrained individuals to remove and replace cathode elements quickly without fear of damaging components or without substantial downtime. A spare cathode assembly can be kept on hand for quick replacement while the removed cathode assembly is sent to a refiner or is recharged with new cathode elements. The cathode elements according to the invention permit silver to be recovered with comparatively little difficulty compared to prior silver recovery techniques. The configuration of the barrel assures that effective plating action will occur due to proper flow and agitation characteristics. Further, the bearing assemblies disclosed for the drive shaft are inexpensive, easy to assembly and remain operable even if their supporting structures are misaligned. The latter feature permits the bearing support structures to be manufactured quickly and inexpensively without concern for maintaining close tolerances.

Although the invention has been described in its preferred form with a certain degree of particularity, it is understood that the present disclosure of the preferred embodiment has been made only by way of example and that various changes may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. Apparatus for recovering metal from a solution containing metal ions, comprising:

(a) a tank into which metal ion-containing solution is directed;
(b) at least one elongate anode disposed within the tank, the anode being maintained stationary with respect to the tank;
(c) a pair of spaced electrodes disposed within the tank, the electrodes being maintained stationary with respect to the tank;
(d) an elongate cathode assembly supported for rotation between, and in electrical communication with, the electrodes, the cathode assembly being readily insertable into, and removable from, its position between the electrodes; and
(e) a cathode assembly drive for rotating the cathode assembly about a longitudinal axis, the cathode assembly drive at least partially supporting the cathode assembly during rotation of the cathode assembly.

2. The apparatus of claim 1, wherein the connection between the cathode assembly and the cathode assembly drive includes a frictional engagement between a drive shaft included as part of the cathode assembly drive and the outer surface of the cathode assembly.

3. The apparatus of claim 1, wherein the cathode assembly includes:
(a) a barrel of electrically nonconductive material, the barrel including apertures for the ingress and egress of solution;
(b) a plurality of cathode elements disposed within the barrel; and
(c) an electrical connection between the cathode elements and an exterior portion of the barrel, whereby electrical contact between the electrodes and the cathode elements is established.

4. The apparatus of claim 3, wherein the barrel is cylindrical and the cathode elements include a plurality of thin discs concentrically disposed within the barrel and being spaced equidistantly axially of the barrel, the discs being electrically conductive and in electrical communication with each other.

5. The apparatus of claim 4, wherein the discs are separated by spacers and a given disc and its adjacent spacer are formed as a unitary assembly.

6. The apparatus of claim 5, wherein:
(a) the unitary assembly is formed by being molded from a plastic material; and
(b) a coating of electrically conductive material is applied to the surface of the unitary assembly.

7. The apparatus of claim 3, wherein the cathode elements include:
(a) an electrically conductive impeller disposed within the barrel, the impeller, upon rotation of the barrel, causing solution to move into and out of the barrel; and
(b) a plurality of electrically conductive parts disposed within the barrel, the parts, upon rotation of the barrel, being tumbled about within the barrel and being brought into contact with the impeller, the solution, and each other.

8. The apparatus of claim 7, wherein:
(a) an elongate, electrically conductive member supports the impeller, for rotation about an axis coincident with the axis of rotation of the barrel, the member being maintained at an opposite polarity compared to that of the impeller and the parts; and
(c) the plurality of electrically conductive parts serve as cathode elements onto which metal is plated.

9. The apparatus of claim 8, wherein a perforated, electrically nonconductive sheath is disposed about the elongate electrically conductive member to insulate the parts and the impeller from the member.

10. The apparatus of claim 7, wherein the parts include tubular, molded plastic members coated with a layer of electrically conductive material.

11. The apparatus of claim 3, wherein the cathode elements comprise:
(a) an elongate shaft extending the length of the barrel and protruding from each end of the barrel, the shaft providing an axis about which the barrel rotates, the shaft being electrically conductive and of a sufficient length that electrical contact between the shaft and the electrodes exists when the barrel is placed in the tank;
(b) a plurality of paddles fixed to the shaft, the paddles being spaced axially of the shaft and at different angular orientations with respect to the shaft, the paddles being electrically conductive and in electrical communication with the shaft;
(c) a plurality of electrically conductive parts disposed within the barrel, the parts, upon rotation of the barrel, being tumbled about within the barrel and being brought into contact with the shaft, the paddle and each other.

12. The apparatus of claim 11, wherein the shaft and the paddles are formed as an integral unit from a plastic material, the integral shaft and paddles being coated with a layer of electrically conductive material.

13. The apparatus of claim 3, wherein the barrel includes:
(a) a plurality of axially extending projecting portions which, during rotation of the barrel, act as paddles to agitate solution;
(b) a plurality of circumferentially extending slots formed in the barrel; and
(c) a plurality of apertures formed in the ends of the barrel.

14. The apparatus of claim 13, wherein the barrel includes an end cap secured to each end of the barrel, at least one end cap being removable to permit cathode elements to be inserted into and removed from the barrel, the end caps providing a guiding surface for insertion of the barrel into the tank and a drive surface for engagement between the cathode assembly and the cathode assembly drive.

15. The apparatus of claim 1, wherein the cathode assembly drive includes a drive shaft disposed within the tank and supported for rotation about a longitudinal axis, the drive shaft extending through a tank wall and being supported and sealed at the interface between the shaft and the wall by means of a fluid-tight seal.

16. The apparatus of claim 15, wherein the seal includes:
(a) a flexible, fluid-tight web extending across the opening in the wall and being sealed about the periphery of the opening;
(b) a bearing having a longitudinal opening, the bearing being carried by the web and extending completely through the web, the bearing providing a fluid-tight seal at the interface between the web and the bearing; and
(c) the bearing being constructed of a material sufficiently friction-free that the shaft is tightly fitted within the opening in fluid-tight relationship and rotation between the bearing and the shaft is permitted.

17. The apparatus of claim 16, further including:
(a) a flexible seal engageable with the shaft and an end face of the bearing; and,
(b) means carried by the shaft to compress the flexible seal into fluid-tight engagement with the shaft and the end face of the bearing.

18. The apparatus of claim 1, wherein the longitudinal axis of the anode is placed generally horizontally and the longitudinal axis of the cathode assembly is parallel with the longitudinal axis of the anode.

19. Shaft seal and bearing apparatus for supporting a shaft for rotation about a longitudinal axis of the shaft, the apparatus providing a fluid-tight seal between the shaft and a housing into which the shaft extends through an opening in a wall of the housing, comprising:
(a) a flexible, fluid-tight web extending across the opening and being sealed about the periphery of the opening;
(b) a bearing having a longitudinal opening, the bearing being carried by the flexible web and extending completely through the web, the bearing being sealed to the web in fluid-tight relationship, the bearing being constrained against movement with respect to the housing except for pivotal movement of the longitudinal axis of the bearing and a plane in which the wall of the housing lies; and
(c) the bearing being constructed of a material sufficiently friction-free that the shaft can be fitted tightly within the opening in fluid-tight relationship, but rotation between the bearing and the shaft still is possible.

20. The shaft seal and bearing apparatus of claim 19, further including:
(a) a flexible seal engageable with the shaft and an end face of the bearing; and,
(b) means carried by the shaft to compress the flexible seal into fluid-tight engagement with the shaft and the end face of the bearing.

21. The shaft seal and bearing apparatus of claim 19, wherein the longitudinal axis of the bearing can be pivoted approximately 10 degrees in any direction with respect to the plane in which the wall lies.

22. A cathode assembly for use in an electroplating operation, the assembly comprising:
(a) a barrel of electrically non-conductive material, the barrel including apertures for the ingress and egress of solution used in the plating operation;
(b) a plurality of cathode elements disposed within the barrel, the cathode elements including a plurality of thin discs concentrically disposed within the barrel and spaced equidistantly axially of the barrel, the discs being electrically conductive and in electrical communication with each other; and
(c) an electrical connection between the cathode elements and an exterior portion of the barrel.

23. The cathode assembly of claim 22, wherein the discs are separated by spacers and a given disc and its adjacent spacer are formed as a unitary assembly.

24. The cathode assembly of claim 23, wherein:
(a) the unitary assembly is formed by being molded from a plastic material; and,
(b) a coating of electrically conductive material is applied to the surface of the unitary assembly.

25. A portable unit for recovering metallic silver from photographic processing solutions containing silver ions, comprising:
(a) a tank into which processing solution is directed;
(b) at least one elongate anode disposed within the tank, the anode being positioned horizontally and maintained stationary with respect to the tank;
(c) a pair of spaced electrodes disposed within the tank, the electrodes being maintained stationary with respect to the tank;
(d) an elongate cathode assembly supported for rotation between, and in electrical communication with, the electrodes, the cathode assembly being readily insertable into, and removable from, its position between the electrodes, the cathode assembly including:
(i) a cylindrical barrel of electrically nonconductive material, the barrel including apertures for the ingress and egress of solution, the barrel when viewed from the end including a plurality of alternating, axially extending small-diameter portions and larger-diameter portions;
(ii) end caps secured to each end of the barrel, the end caps including a plurality of apertures, the end caps also including support surfaces for guiding the cathode assembly into engagement with electrodes and for supporting the cathode assembly for rotation;
(iii) a plurality of cathode elements disposed within the barrel, the cathode elements comprising thin discs concentrically disposed within the barrel and being spaced equidistantly axially of the barrel, the discs being electrically conductive and electrical communication with each other, the discs, upon rotation of the barrel, creating a low pressure region between the discs so that solution is drawn into the barrel through the end caps and discharged from the barrel through the apertures in the barrel; and
(iv) an electrical connection between the cathode elements and an exterior portion of the barrel in order to establish electrical contact between the cathode elements and the electrodes; and
(e) a cathode assembly drive for rotating the cathode assembly about a horizontal axis parallel to the axis of the anode, the cathode assembly drive at least partially supporting the cathode assembly during rotation of the cathode assembly and including an elongate drive shaft engageable frictionally with the cathode assembly, whereby, upon rotation of the drive shaft, the barrel simultaneously is rotated and supported.

26. Shaft seal and bearing apparatus for supporting a shaft for rotation about a longitudinal axis of the shaft, the apparatus providing a fluid-tight seal between the shaft and a housing into which the shaft extends through an opening in a wall of the housing, comprising:
(a) a flexible, fluid-tight web extending across the opening and being sealed about the periphery of the opening;
(b) a bearing having a longitudinal opening, the bearing being carried by the flexible web and extending completely through the web, the bearing being sealed to the web in fluid-tight relationship;
(c) the bearing being constructed of a material sufficiently friction-free that the shaft can be fitted within the opening in fluid-tight relationship, but relative motion between the bearing and the shaft still is possible;
(d) a flexible seal engageable with the shaft and an end face of the bearing; and (e) means carried by the shaft to compress the flexible seal into fluid-tight engagement with the shaft and the end face of the bearing.

27. The shaft seal and bearing apparatus of claim 26, wherein the bearing is constrained against movement with respect to the housing by the web except for pivotal movement of the longitudinal axis of the bearing and a plane in which the wall of the housing lies.

28. The shaft seal and bearing apparatus of claim 27, wherein the longitudinal axis of the bearing can be moved approximately 10 degrees in any direction with respect to the plane in which the wall lies.

29. An assembly for use in an electroplating operation, the assembly comprising:

(a) a barrel of electrically non-conductive material, the barrel including apertures for the ingress and egress of solution used in the plating operation;

(b) a plurality of cathode elements disposed within the barrel, the cathode elements including an electrically conductive impeller disposed within the barrel, the impeller, upon rotation of the barrel, causing solution to move into and out of the barrel;

(c) a plurality of electrically conductive parts disposed within the barrel, the parts, upon rotation of the barrel, being tumbled about within the barrel and being brought into contact with the impeller, the solution, and each other; and, (d) an electrical connection between the cathode elements and an exterior portion of the barrel.

30. The assembly of claim 29, wherein:

(a) the impeller includes a plurality of vanes radiating outwardly from a hub; and (b) an elongate, electrically conductive member supports the hub and, hence, the vanes, for rotation about an axis coincident with the axis of rotation of the barrel, the electrically conductive member being connected to the hub by means of an insulator.

31. The assembly of claim 30, wherein a perforated, electrically nonconductive sheath is disposed about the elongate, electrically conductive member.

32. The assembly of claim 29, wherein the parts include tubular, molded plastic members coated with a layer of electrically conductive material.

33. A cathode assembly for use in an electroplating operation, the assembly comprising:

(a) a barrel of electrically non-conductive material, the barrel including apertures for the ingress and egress of solution used in the plating operation;

(b) a plurality of cathode elements disposed within the barrel, the cathode elements including an elongate shaft extending the length of the barrel and protruding from each end of the barrel, the shaft having an axis about which the barrel rotates, the shaft being electrically conductive and of a sufficient length that electrical contact between interior portions of the barrel and exterior portions of the barrel is made possible;

(c) a plurality of paddles fixed to the shaft, the paddles being spaced axially of the shaft and at different angular orientations with respect to the shaft, the paddles being electrically conductive and in electrical communication with the shaft; and (d) a plurality of electrically conductive parts disposed within the barrel, the parts, upon rotation of the barrel, being tumbled about within the barrel and being brought into contact with the shaft, the paddle, and each other.

34. The cathode assembly of claim 33, wherein the shaft and the paddles are formed as an integral unit from a plastic material, the integral shaft and paddle being coated with a layer of electrically conductive material.

35. A cathode assembly for use in an electroplating operation, the assembly comprising:

(a) a barrel of electrically non-conductive material, the barrel including apertures for the ingress and egress of solution used in the plating operation, the barrel also including:

(i) a plurality of axially extending projecting portions which, during rotation of the barrel, act as paddles to agitate solution;

(ii) a plurality of circumferentially extending slots formed in the barrel; and (iii) a plurality of apertures formed in the ends of the barrel;

(b) a plurality of cathode elements disposed within the barrel; and (c) an electrical connection between the cathode elements and an exterior portion of the barrel.

36. The cathode assembly of claim 35, wherein the barrel includes an end cap secured to each end of the barrel, at least one end cap being removable to permit cathode elements to be inserted into and removed from the barrel.

37. The cathode assembly of claim 35, wherein the barrel includes:

(a) a cylindrical body portion, the body portion when viewed from the end being defined by alternating smaller-diameter and larger-diameter portions, the portions extending axially of the body portion for the length of the body portion; and (b) end caps secured to each end of the body portion, the end caps including apertures.

38. The cathode assembly of claim 37, wherein the apertures in the body portion include a plurality of circumferentially extending slots formed in the larger-diameter portions.

* * * * *